US007182508B2

(12) United States Patent
Bertrand et al.

(10) Patent No.: US 7,182,508 B2
(45) Date of Patent: Feb. 27, 2007

(54) LINKING DEVICE BETWEEN A RIM AND A CASE OF WATCH

(75) Inventors: Jean-Louis Bertrand, Viry (FR); Daniel Fiammingo, Sciez (FR); Daniel Moille, Yvoire (FR); William Passaquin, Armoy (FR); Sylvie Ribeyrolles, Loisin (FR); Yvan Serikoff, Ville la Grand (FR)

(73) Assignee: Rolex S.A., Geneva (CH)

( * ) Notice: Subject to any disclaimer, the term of this patent is extended or adjusted under 35 U.S.C. 154(b) by 308 days.

(21) Appl. No.: 10/915,913

(22) Filed: Aug. 11, 2004

(65) Prior Publication Data

US 2005/0007890 A1 Jan. 13, 2005

(51) Int. Cl.
*G04B 37/00* (2006.01)

(52) U.S. Cl. ..... 368/295

(58) Field of Classification Search ..... 368/294, 368/295, 299, 300, 88, 309
See application file for complete search history.

(56) References Cited

U.S. PATENT DOCUMENTS

| | | | | |
|---|---|---|---|---|
| 4,244,044 | A * | 1/1981 | Olsson | 368/291 |
| 4,975,893 | A * | 12/1990 | Dal Busco | 368/294 |
| 5,490,123 | A * | 2/1996 | Biver | 368/295 |

FOREIGN PATENT DOCUMENTS

| | | |
|---|---|---|
| CH | 503306 | 9/1970 |
| EP | 0628895 | 12/1994 |
| EP | 0770937 | 5/1997 |
| JP | 10 039049 | 4/1998 |
| WO | WO 02 44818 | 6/2002 |

OTHER PUBLICATIONS

Hytrel Thermoplastic Polyester Elastomer: plastics.dupont.com/NASApp/myplastic/Mediator?id=75=locale=en_US; Apr. 18, 2003.*
Plastics Dupont: plastics.dupont.com/NASApp/Mediator?id=79&locale=en_US; Sep. 3, 2003.*
Hytrl DYM350BK data sheet: plastics.dupont.com/plastics/dsheets/hytrel/AHYTRELDYM350BK.pdf?GXHC_gx_session_id_=d9885994448ea4f1&GXHC_locale=en_US; Sep. 3, 2003.*

* cited by examiner

*Primary Examiner*—Vit Miska
*Assistant Examiner*—Sean Kayes
(74) *Attorney, Agent, or Firm*—Sturm & Fix LLP

(57) ABSTRACT

This device comprises a first axial retention shoulder secured to the case, adjacent to a cylindrical seat, a second, opposite axial retention shoulder formed by one face of an annular groove secured to the rim, an annular retention element made of polymer bearing against each of said shoulders, said first shoulder being adjacent to the base of a conical surface, secured to the case, for the axial introduction of said annular retention element engaged with said annular groove. Said annular retention element forms an endless ring whose section is divided in the radial direction into two portions of which one is, perpendicularly to the plane of said endless ring, substantially thinner than the other, these two portions being intended to interact respectively with said first shoulder and second shoulder.

11 Claims, 3 Drawing Sheets

LINKING DEVICE BETWEEN A RIM AND A CASE OF WATCH

CROSS REFERENCE TO RELATED APPLICATIONS

This application claims priority of European Application No. 03405638.2 filed Sep. 3, 2003, which is included in its entirety by reference made hereto.

BACKGROUND OF THE INVENTION

Field of the Invention

The present invention relates to a linking device between a rim and a case of a watch comprising a first axial retention shoulder secured to the case, adjacent to a cylindrical seat, a second, opposite axial retention shoulder formed by one face of an annular groove secured to the rim, an annular retention element made of polymer bearing against each of said shoulders, said first shoulder being adjacent to the base of a conical surface, secured to the case, for the axial introduction of said annular retention element engaged with said annular groove, this annular retention element allowing the removal of the rim when a force greater than its resistance is applied to the rim.

BRIEF SUMMARY OF THE INVENTION

A device of this kind has already been proposed in EP 0 770 937 wherein a rotating rim is attached by means of a split collar made of plastic of the circlip type. Given that such a method of attaching a rim is not reversible, to remove the rim, it is necessary to exert on this split collar a traction suitable to shear it. The latter is made of a polymer able to break when sufficient axial tension is applied to the rim. To ensure that the split collar can resume its initial shape after having been dilated by the conical introduction surface, this collar should preferably be made of a plastic having a relatively high elastic limit or, more usually, yield strength corresponding to the onset of flow and a relatively high shear strength. These conditions are however unfavorable for the removal of the rim given that they require the exertion of a high force on the rim which risks leaving marks on the rim and on the case. In addition, such a method of linking the rim and the case applies only to rotating rims.

The aim of the present invention is to overcome, at least in part, the aforementioned disadvantages and limitations.

As a result, the object of this invention is a linking device between a rim and a case of a watch, according to claim 1.

The main advantages of this invention are the use of an annular retention element in the form of a ring and the fact that the section of this ring comprises two rectangular portions one of which is substantially thinner than the other. The portion of the thin section of the ring needs to be destroyed when the rim is removed. Advantageously, the material used to make the endless ring is a thermoplastic elastomer. Such a ring can at the same time serve to easily assemble the pieces together, retain them well and remove them easily, thanks to the thin portion of the ring, without risk of damaging the case, the rim or the two pieces.

The transition from the method of fixing by "clipping" to the method using an endless ring is not straightforward, contrary to what may be thought at first sight. Specifically, the thinner portion of the ring must bear practically on all its surface, or, with reference to its section, on practically its whole radial length, both to provide a secure attachment of the rim and to be sheared when the rim is removed. When the rim furnished with this ring is put in place, the ring must dilate while passing over a conical surface before retracting and taking hold under the shoulder, by resuming an internal diameter corresponding to that of its cylindrical seat secured to the case. During this dilation, a space, corresponding substantially to that dilation, must be made between the outer surface of the portion of larger section of the retention ring and the adjacent surface of the rim. As has been explained above, this space must be as small as possible.

This also means that the radial dimension of the shoulder retaining the retention ring and consequently the rim must also be very small, which is possible only if the edge of this shoulder is sharp. Specifically, if such were not the case, attachment of the rim would not be assured. An advantage resulting from the very little clearance between the external surface of the thicker portion of the retention ring and the adjacent surface of the rim is that it allows the centering of the rim.

The retention ring made of thermoplastic elastomer also has the advantage of serving as an element holding back a rotating rim when the latter is moved away from the middle by elastic means and retained by a noncylindrical surface of this retention ring. Given the size of the surfaces helping to hold back the rim, a light manual pressure in the opposite direction is used to release the rim to make it rotate.

Another very important advantage resulting from the use of a retention ring made of a soft polymer, particularly a thermoplastic elastomer, arises from the fact that it is not limited to the attachment of rotating rims, as is the case with a circlip, but that it can be used just as well for attaching nonrotating rims, as will be seen during the ensuing description.

Other features and advantages of the present invention will appear on reading the following description which will be made with the aid of the appended drawings which illustrate, schematically and in exemplary manner, several embodiments of watch cases whose rims are attached with the aid of the linking device that is the object of the present invention.

DETAILED DESCRIPTION OF THE INVENTION

Figure 1:
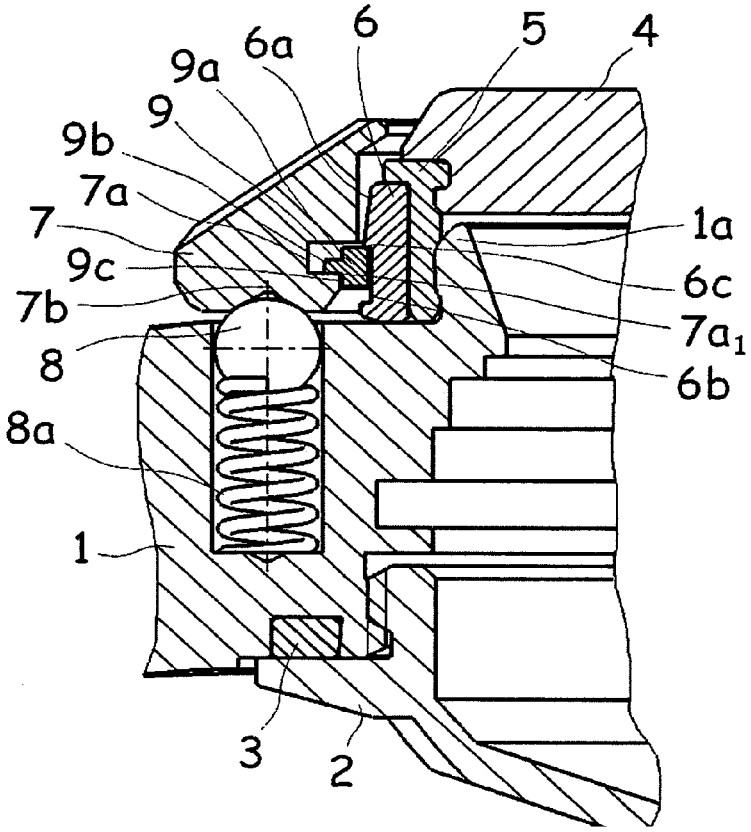
FIG. 1 is a partial view in diametral section of a watch case comprising a first embodiment of this device.

The watch case illustrated by FIG. 1 comprises a middle 1 to which a base 2 is screwed with interposition of a seal 3. A glass 4 is attached in a sealed manner over the top opening of the middle 1 by an annular glass seal 5 which extends around the glass 4 and a top portion 1*a* of the middle 1. A clamping collar 6 serves to exert a centripetal pressure on the annular glass seal 5, to attach the glass 4 in sealed manner onto the middle 1.

The outer lateral face of the clamping collar 6 exhibits a conical surface 6*a* followed by a cylindrical surface 6*b* whose diameter is slightly less than that of the base of the adjacent conical surface 6*a*, thus making a shoulder 6*c* between the two surfaces 6*a*, 6*b*.

A rotating rim 7 is mounted onto the middle 1 by means of roller balls 8 pressed in a direction parallel to the axis of the middle 1 by springs 8*a* in a raceway 7*b*. There are at least three of these roller balls 8 with springs distributed at equal angular distances from one another.

The linking device between this rim 7 and the middle 1 comprises an annular retention element 9 made of a polymer material, whose section exhibits two portions 9*a*, 9*b*, each, in this example, of rectangular section. The portion 9*a* is on the inside, while the portion 9*b* is on the outside of the element 9. The thickness of the portion 9*b*, that is to say its dimension perpendicular to the plane of the annular element 9, is substantially less than that of the portion 9*a*, thus forming a mounting flange 9*b* around the thicker inner portion 9*a*. In preference, the mounting flange 9*b* is situated at the center of the thickness of the inner annular portion 9*a*.

This mounting flange 9*b* is engaged in an annular groove 7*a* of the rim 7 and its bottom flat annular face comes into contact with the bottom edge of this annular groove 7*a* perpendicular to the plane of the annular retention element 9, forming a bottom bearing shoulder $7a_1$. The top annular flat face of the thicker annular portion 9*a* of the annular retention element 9 is in contact with the shoulder 6*c* of the clamping collar of the glass seal 5, which forms a top bearing shoulder.

Advantageously, the annular retention element 9 is made of a thermoplastic elastomer (TPE) which, amongst other things, has the advantage of being able to be made by injection molding, so with very precise dimensions. Such a material has a sufficient elasticity to dilate radially and resume its initial shape when the rim 7 is put in place. This involves above all a material that exhibits a low elastic modulus, a low tensile strength and a low yield strength. Thanks to these properties, the mounting flange 9*b* can be of a thickness sufficient to be able to produce the retention element 9 by injection molding, while allowing this mounting flange 9*b* to tear when the rim 7 is removed without having to exert too great a force, which would be likely to damage the rim 7, even the middle 1 also. TPEs suitable for the fabrication of the retention element 9 are sold in particular under the Hytrel® brand.

To mount the rim 7 onto the middle 1, the process begins by driving the glass 4 fitted with the seal 5 and the clamping collar 6 onto the portion 1*a* of the middle 1. Then, the retention element 9, in particular its mounting flange 9*b*, is inserted into the groove 7*a* of the rim 7. This assembly is placed around the conical surface 6*a* of the clamping collar, whose smallest diameter corresponds substantially to the internal diameter of the retention element 9. Then an axial force is exerted on the rim 7 to bring the rim 7, retention ring 9 assembly into the position illustrated in FIG. 1.

During its movement along the conical surface 6*a*, the retention element 9 is subject to a radial dilation. Because of its properties, it resumes its initial diameter, even a slightly greater diameter, if the diameter of the surface 6*b* of the clamping collar is slightly greater than its initial diameter. In all cases, the inner face of the retention element 9 must be in close contact with the cylindrical surface 6*b* of the clamping collar 6 so that the shoulder 6*c* provides the axial immobilization of the annular retention element 9. This axial immobilization must be sufficient to prevent this retention element 9 from moving over the shoulder 6*c* when the rim 7 is removed. In this case, the axial force exerted on the rim 7 must shear the mounting flange 9*b*.

This shearing of the mounting flange 9*b* can be achieved only if the diametral clearance between the outer cylindrical surface 9*c* situated under the mounting flange 9*b* of the portion 9*a* of the retention element 9 and the inner cylindrical surface of the rim 7, situated below the annular groove 7*a* lies between one and two times the radial dimension of the shoulder 6*c*, which makes the radial distance between these two adjacent cylindrical surfaces between ½ and 1 times the radial dimension of the shoulder 6*c*.

The radial dimension of this shoulder 6*c* must be as small as possible, while making it possible to ensure the immobilization of the retention element 9 as previously explained. The reasons for the need for this small dimension are twofold. On the one hand, it is required because of the use of an endless annular retention element 9, on the other hand it is also required by the small amount of clearance that must exist between the outer cylindrical surface 9*c* of the retention element 9 and the adjacent cylindrical surface of the rim 7, in order to ensure a good contact of the mounting flange 9*b* and hence good retention of the rim 7 and allow the mounting flange 9*b* to shear when the rim 7 is removed. Although the material used for the retention element is preferably a thermoplastic elastomer which tolerates a certain compression, the latter may only be very weak, of the order of 2 or 3 hundredths of a millimeter. The radial dimension of the shoulder 6*c* of the clamping collar must for its part be of the order of 10 hundredths of a millimeter, on condition that a sharp edge is ensured between this shoulder 6*c* and the conical surface 6*a*.

It follows from the foregoing that if the clearance between the cylindrical surface 9*c* of the retention element 9 and the adjacent cylindrical surface of the rim 7 is small, these two cylindrical surfaces may advantageously serve as guidance for the rim 7, which would not be possible with a circlip type of attachment.

Hitherto it has been said that the retention element 9 was advantageously made of a thermoplastic elastomer, due to the fact that the latter exhibits good chemical resistance, that it allows the resumption of its initial shape and diameter after having been subjected to a radial dilation when the rim 7 is put in place and that it does not require the application of too great a force likely to damage the rim and/or the middle in order to shear the mounting flange 9*b*, while making it possible to give the mounting flange a thickness compatible with its production by injection molding.

It would however be possible to use other polymers. Particular mention may be made of polyoxymethylene POM which is an acetal resin, such as Delrin® 100ST whose Young's modulus=1400 MPa, yield strength=43 MPa and tensile strength=45 MPa. Mention may also be made of polybutylene terephthalate PBT such as Crastin® ST820 whose Young's modulus=1600 MPa, yield strength=35 MPa and tensile strength=40 MPa.

Of course other polymers may be found suitable for the fabrication of this retention element 9. Polymers may also be chosen that exhibit a higher yield strength or tensile strength, depending on the properties sought. It is also possible to vary the dimensions, particularly the thickness of the mounting flange 9*b* according to the material chosen and the properties sought.

Figure 2:
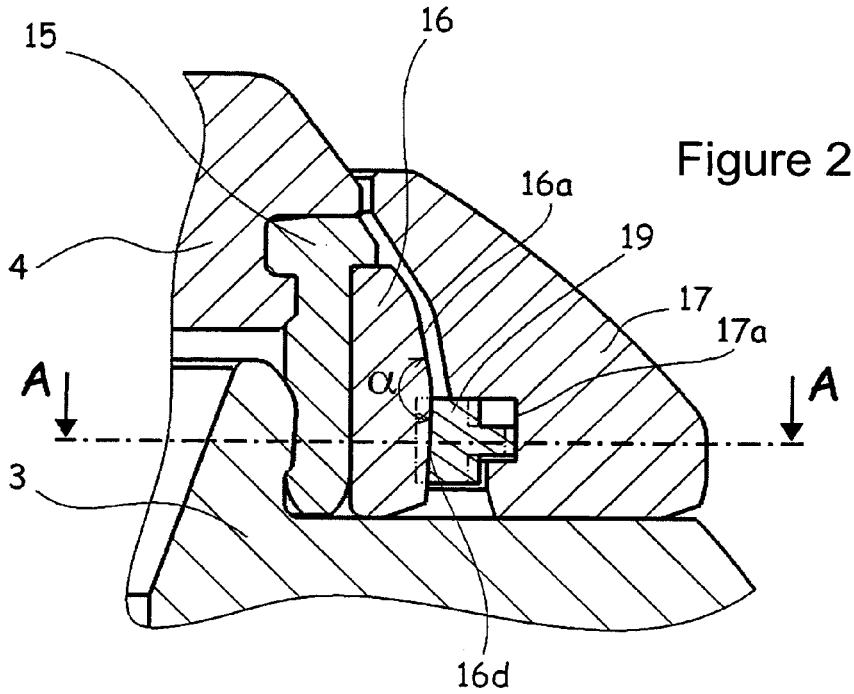
FIG. 2 is a first partial view in diametral section of a watch case comprising a second embodiment of this device.
Figure 3:
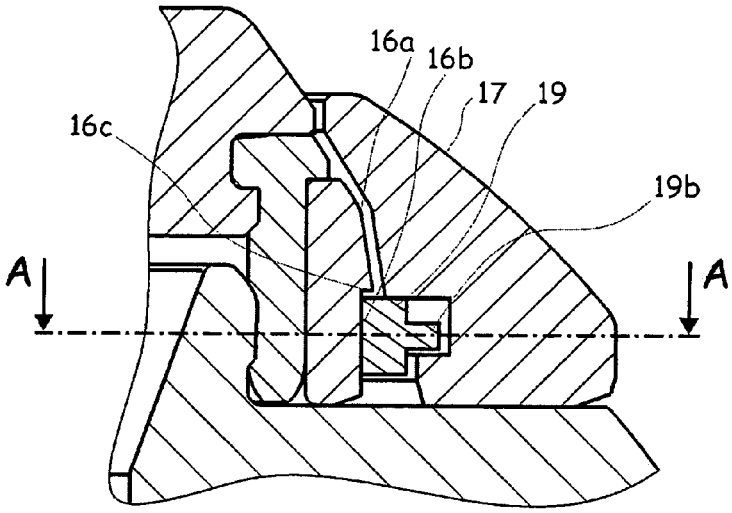
FIG. 3 is a view similar to FIG. 2 in which the diametral section is angularly offset.
Figure 4:
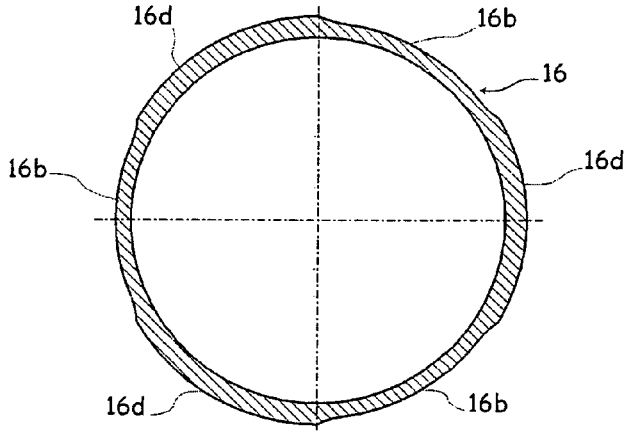
FIG. 4 is a plan view of the portion secured to the middle around which the linking device is attached.

The second embodiment illustrated in FIGS. 2 to 4 differs from the preceding one essentially by the fact that the linking device is used for the attachment of a fixed rim 17.

The only difference between this embodiment and the preceding one arises from the fact that the outer cylindrical face 16*c* of the clamping collar 16 of the glass seal 15 is interrupted at angular distances regularly distributed over three sectors 16*d* of greater radii, as illustrated by FIGS. 2 and 4. These sectors 16*d* do not form a shoulder 16*c* with the base of the conical surface 16*a*. These sectors 16*d* however form an obtuse angle α (with the conical surface 16*a*, preferably themselves forming a slight cone of inclination inverse to that of the conical surface 16*a*.

With this conformation of the clamping collar 16, only its three sectors 16*b* still comprise a shoulder 16*c*, the latter disappearing in the sectors 16*d*. FIG. 3 illustrates the retention element 19 situated in a sector 16*b* where it is retained by the shoulder 16*c* and in which the rim 17 is retained by the mounting flange 19*b* as in the preceding embodiment. FIG. 2 shows a sector 16*d* of the clamping collar 16 which exerts a radial compression on the retention element 19 while dilating it. Thanks to this compression of the retention element between the clamping collar 16 on the one hand and the base of the annular groove 17*a* of the rim on the other hand, the rim 17 is immobilized in rotation, which then allows the linking device according to the present invention to be used also for the attachment of fixed rims.

Figure 5:
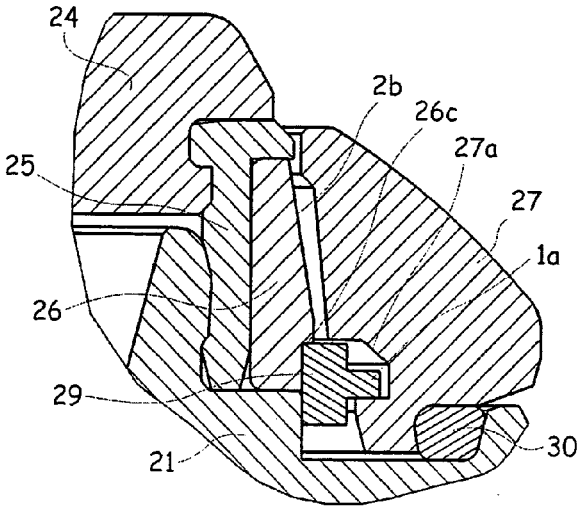
FIG. 5 is a partial view in diametral section of a watch case comprising a third embodiment of this device.

The embodiment illustrated by FIG. 5 relates also to the attachment of a fixed rim 27. To immobilize this rim 27, a compressible seal 30 made of a material with a high friction coefficient is compressed between the rim 27 and the middle 21. The annular retention element 29 is retained as in the preceding embodiments by the shoulder 26*c* of the clamping collar 26 of the seal 25 of the glass 24. One advantage of this embodiment is that, when the rim 27 is put in place, the seal 30 can be compressed such that the annular retention element 29 descends below the shoulder 26*c* of the clamping collar 26. When the pressure on the rim 27 ceases, the seal 30 then presses the retention element 29 against the shoulder 26*c*. Because of the compression of this seal 30 and of the material of high friction coefficient of which it is made, the rim cannot rotate.

Figure 6:
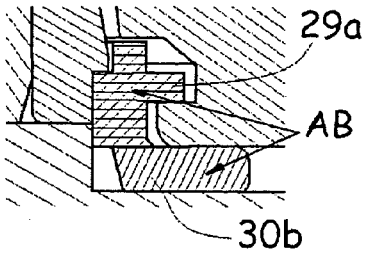
FIGS. 6 and 7 are very partial views of two variants of FIG. 5.

The variant illustrated in FIG. 6 differs from the embodiment in FIG. 5 only by combining the annular retention element 29 and the seal 30 for immobilizing the rim into a single composite annular unit AB comprising two pieces 29*a*, 30*b* of different materials, bonded to one another. Each of these pieces 29*a*, 30*b* plays the same role as the retention element 29, respectively the seal 30.

Figure 7:
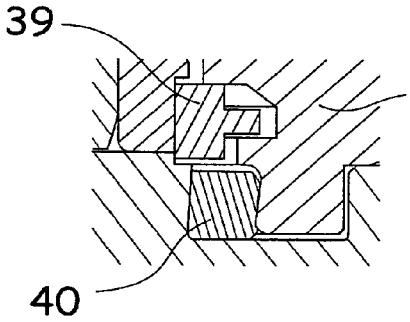

The variant illustrated by FIG. 7 again shows the annular retention element 39 and the compressible seal 40 for immobilizing the rim. However, in this variant, the seal 40 is compressed radially by the rim 37 and not axially as in the case in FIGS. 5 and 6.

Figure 8:
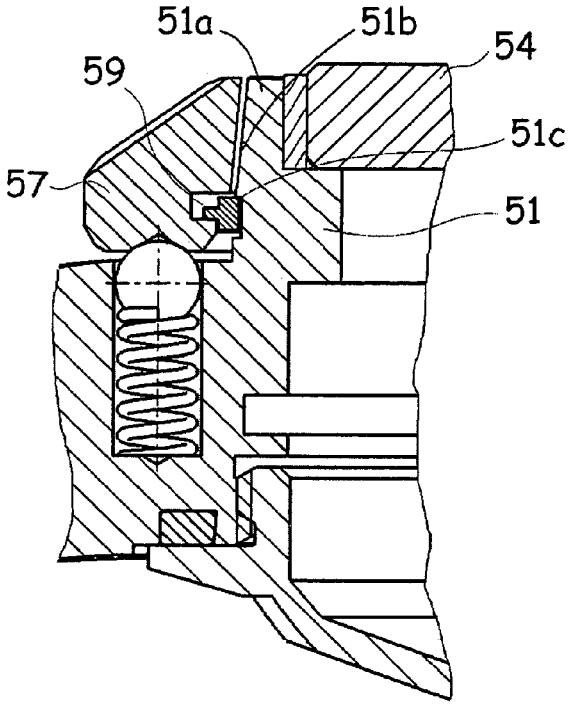
FIG. 8 is a partial view in section of a variant of FIG. 1.

FIG. 8 represents a variant of FIG. 1 in which the glass 54 is fitted into a flange 51*a* of the middle 51. In this variant, the retention element 59 comes into direct engagement with a shoulder 51*c* made on the outer lateral face of the middle 51, at the base of the conical surface 51*b*, serving as an axial stop to the retention element 59 in the same manner as in the preceding embodiments. This variant shows a rotating rim 57. Of course a fixed rim mounting could be achieved according to this variant, adapted to one of FIGS. 5 to 7 in particular.

Figure 9:
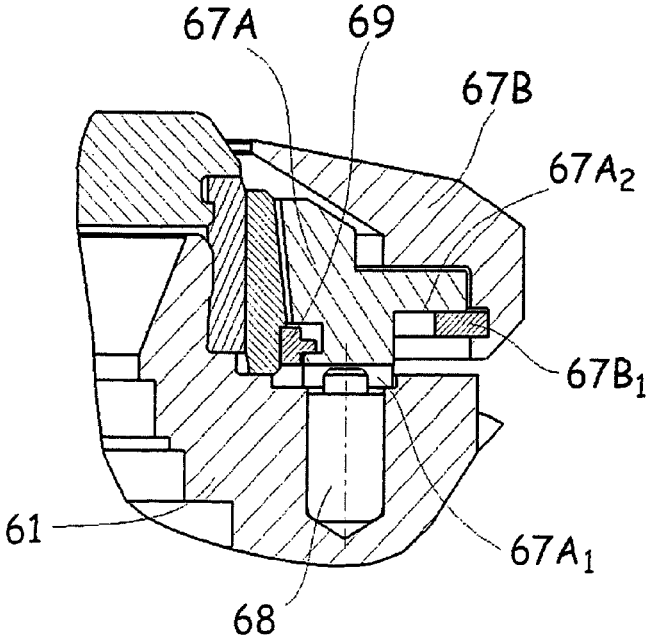
FIG. 9 is a partial view in diametral section of a watch case comprising a final embodiment of this device.

The last embodiment illustrated by FIG. 9 comprises a rim in two concentric annular portions, one inner 67A, the other outer 67B, connected to one another by a split elastic ring $\mathbf{67}B_1$ of the circlip type, secured to the outer portion 67B. This elastic ring $\mathbf{67}B_1$ forms an axial retention shoulder, against which a surface $\mathbf{67}A_2$ of the inner portion 67A of the rim presses, allowing the outer portion 67B to rotate relative to the inner portion 67A. In this embodiment, a pivot stop pawl 68 is in engagement with a position detent $\mathbf{67}A_1$ made on the lower face of the inner portion 67A of the rim and immobilizing it. Other means of immobilization could replace the pivot pawl 68.

The inner portion 67A of this two-part rim is connected to the case middle 61 by the annular retention element 69 in the same manner as in the embodiments previously described. The removal of this rim will be achieved by removing the two portions 67A, 67B, the latter being secured in their axial movement although free to rotate one against the other.

The invention claimed is:

1. A linking device between a rim and a case of a watch comprising a first axial retention shoulder secured to the case, adjacent to a cylindrical seat, a second, opposite axial retention shoulder formed by one face of an annular groove secured to the rim, an annular retention element made of polymer bearing against each of said shoulders, said first shoulder being adjacent to the base of a conical surface, secured to the case, for the axial introduction of said annular retention element engaged with said annular groove, this annular retention element allowing the removal of the rim when a force greater than its resistance is applied to the rim, wherein said annular retention element forms a full endless ring whose section is divided in the radial direction into two portions of which one is, perpendicularly to the plane of said ring, substantially thinner than the other, these two portions being intended to interact respectively with said first shoulder and second shoulder and wherein the radial dimension of said first axial retention shoulder lies between one and two times the diametral clearance between the rim and said outer circular surface of said retention element forming a surface for positioning the rim.

2. The device as claimed in claim 1, wherein said first axial retention shoulder is interrupted on three equidistant angular segments to form circular sectors for the compression of said annular retention element between these circular sectors and the rim in order to immobilize the latter.

3. The device as claimed in claim 1, wherein a friction element is interposed between the case and the rim in a position for fixing the latter.

4. The device as claimed in claim 3, wherein said friction element is made of a compressible material.

5. The device as claimed in claim 1, wherein at least one of the outer circular surfaces of said annular retention element forms a surface for positioning the rim.

6. The device as claimed in claim 1, wherein said rim comprises two portions mounted one inside the other, having guidance elements allowing them to be made to rotate one in relation to the other, one of these two portions being connected to the watch case by said annular retention element.

7. The device as claimed in claim 1, wherein said axial pressure is exerted via rolling means.

8. The device as claimed in claim 7, wherein the breaking limit in traction of the polymer forming said annular retention element is less than 100 MPa.

9. The device as claimed claim 1, wherein the polymer forming said annular retention element is a TPE.

10. The device as claimed in claim 1, wherein the polymer forming said annular retention element has a Young's modulus of less than 2500 MPa and a yield strength of less than 60 MPa.

11. The device as claimed in claim 1 wherein the radial dimension of the shoulder adjacent to the base of the conical surface is approximately 0.01 mm.

* * * * *